United States Patent [19]

Spaulding

[11] 4,213,404

[45] Jul. 22, 1980

[54] SOLID REFUSE FURNACE

[75] Inventor: David B. Spaulding, Winchester, Mass.

[73] Assignee: Energy Alternatives, Inc., Tualatin, Oreg.

[21] Appl. No.: 959,352

[22] Filed: Nov. 9, 1978

Related U.S. Application Data

[63] Continuation-in-part of Ser. No. 781,540, Mar. 28, 1977, abandoned.

[51] Int. Cl.[2] ..... F23G 5/00

[52] U.S. Cl. ..... 110/229; 110/254; 110/312

[58] Field of Search ..... 122/5; 110/229, 302, 110/309, 312, 218, 180, 181, 254

[56] References Cited

U.S. PATENT DOCUMENTS

| | | | |
|---|---|---|---|
| 404,209 | 5/1889 | Loomis | 110/345 |
| 742,412 | 10/1903 | Gow | 122/5 |
| 964,901 | 7/1910 | Doherty | 110/342 |
| 1,098,534 | 6/1914 | Servais | 110/218 |
| 1,523,414 | 1/1925 | Gibson | 110/218 |
| 2,210,720 | 8/1940 | Johnson et al. | 110/250 |
| 3,190,245 | 6/1965 | Huntington | 110/265 |
| 3,707,129 | 12/1972 | Kawashimo et al. | 110/246 X |
| 3,861,332 | 1/1975 | Itasaka | 110/227 |

FOREIGN PATENT DOCUMENTS

| | | | |
|---|---|---|---|
| 981771 | 1/1951 | France | 110/229 |
| 234066 | 12/1944 | Switzerland | 110/229 |
| 6175 | of 1896 | United Kingdom | 110/256 |

*Primary Examiner*—Michael Koczo
*Attorney, Agent, or Firm*—Schiller & Pandiscio

[57] ABSTRACT

A new furnace is provided which employs a forced draft to efficiently and cleanly burn a wide variety of fuels such as wood and refuse. The furnace is designed to internally and continuously pyrolyze (gasify) fuel prior to the burning phase which is conducted in a lower chamber of the furnace where air is admitted at a controlled rate. Combustion temperature is maintained at 1800° F. or higher to completely burn gasified fuel by enclosing the burning zone with refractory material and by not extracting sensible heat from the combustion region until after exhaust gases exit the lower chamber. Ash is produced in a fine powder as a consequence of its being removed from the combustion effluent by gravity and cyclonic (i.e. turbulent) separation.

21 Claims, 3 Drawing Figures

SOLID REFUSE FURNACE

This invention is a continuation-in-part of my copending U.S. application Ser. No. 781,540 filed Mar. 28, 1977, now abandoned.

This invention relates to furnaces and in particular to a new furnace for space and hot water heating which is adapted to efficiently and cleanly burn a wide variety of fuels such as wood, waste paper, tires and other combustible house and business refuse.

The declining world supply of oil and natural gas and government-imposed limitations on mining and burning coal for ecological reasons have combined to create an "energy crunch" which is reflected in doubling and tripling of the cost of home heating oils and gases and corresponding increases in the cost of coal and electricity generated by combustion of oil, gas or coal. Accordingly substantial efforts have been directed to taking advantage of other sources of energy. One alternative source of energy is wood and combustible solid waste from homes, offices, stores, factories, schools, etc. It has been estimated that the New England states, for example, produce on an average daily basis the following amounts of combustible solids: 20 million pounds of dry or nearly dry fibrous waste such as paper, cardboard, etc.; 2 million pounds of wood waste in the form of boxes, construction refuse, discarded furniture, etc.; 20,000 pounds of vehicle tires, and 222 million pounds of wood from tree growth other than that now managed for pulp, lumber, Christmas trees and the like (although normally thought of as heavily populated, New England as seen from the air is nonetheless almost endless forest). The total fuel value of such material, based on 100% burning efficiency, is sufficient to heat about 1.7 million homes per day.

However, while such combustible solids can be consumed in a properly designed incinerator and the heat of combustion recovered to produce steam, there has been lacking a solid fuel burner sized for single family houses that is capable of converting the solids into clean pollution-free heat. While home-sized solid fuel burners are well-known, they suffer from one or more disadvantages such as inefficient combustion, poor sensible heat recovery, deposit of creosote in stacks, and a tendency to produce smoke. The latter problem is most evident when adding fresh fuel to an old fire, particularly when the fresh fuel is wet or consists of green wood. Other possible problems are difficulty in controlling the combustion rates, with a consequent likelihood of the fire going out due to incomplete combustion or due to fuel being fully consumed prematurely before the time scheduled for addition of fresh fuel, a need to recirculate large amounts of excess air through the fire to improve combustion efficiency and the requirement of a relatively large firebox.

Accordingly, the primary object of this invention is to provide a new solid fuel burner for hot water and space heating purposes which is characterized by simplicity of construction and operation, efficiency of combustion, effluent cleanliness, low capital and maintenance costs, high heat transfer efficiency, a heat output which is large in relation to firebox size, ability to burn various solid fuels (including but not limited to wood, paper, coal, coke, plastics, rubber, waxes and the like), high reliability, ease in starting up, ability to be controlled by fail safe devices and adaptability for operation by a computer or a programmable controller.

A further object is to provide a furnace in which the rate of combustion, thus heat output, can be controlled over a wide range with little or no loss of combustion efficiency over the entire range.

A further object is to provide a solids fuel burner which can be made and operated efficiently in sizes suitable for installation in single family dwellings for space heating or water heating purposes, and also in sizes large enough to satisfy heating requirements in larger buildings, e.g. warehouses, schools and the like.

Still another object is to provide a furnace that can consume wood, paper, rubber tires, and other combustibles and convert them into clean pollution-free heat.

These and other objects hereinafter described or rendered obvious are achieved by providing a furnace which has the ability to efficiently pyrolyze (gasify) its charge of solid fuel prior to burning the fuel. The pyrolyzing phase converts the primary solid fuel into a secondary substance that is capable of being mixed with controlled amounts of air and then burned cleanly and efficiently. In the preferred form of the invention hereinafter described, the fuel decomposition is accomplished in the upper chamber and burning is accomplished partly in the upper and partly in the lower chambers of an insulated firebox, and heat utilization is accomplished by passing the exhaust gases through a heat exchanger where sensible heat is recovered by exchange of heat with a selected fluid. Fuel is fed into the upper chamber of the firebox where it is heated and dried and then moves downward through a pyrolyic zone where the fuel undergoes decomposition and is converted to combustible gases and char (charcoal). These products move downward to a primary burning zone where low temperature combustion is supported by a regulated, but limited, supply of air. Secondary higher temperature burning is completed in the lowest chamber of the firebox under the influence of controlled secondary air supply. A most important feature of the furnace design is the location of the secondary combustion reaction, or fireball, such that it is completely surrounded by refractory, or re-radiating, structures so that the fuel burns at as high a temperature as possible. The high temperature flame, in combination with a stoichiometric and turbulently mixed air-fuel mixture, provides the complete and smoke-free combustion which characterizes this furnace. Ash is accumulated in a section of the furnace below the firebox, while the hot gaseous products of combustion and any unreacted air are withdrawn and passed to a heat exchanger.

Other features and advantages of this invention are set forth in or rendered obvious by the following detailed description which is to be considered with the accompanying drawings wherein.

This invention has four basic requirements or features. First of all, air or oxygen is introduced so that it will tend to pass downward through the burning fuel. This requirement stems from my theory of keeping the fire "old" at all times even when adding new fuel. My theory is based on the discovery that in a conventional fire/grate arrangement where air is supplied to the underside of the grate, the exhaust tends to have less smoke as the fire gets hotter, i.e., "old", and adding fresh wood on top of an old fire always seems to produce smoke due to localized absence of a stoichiometric mixture coupled with insufficient kindling temperature. By supplying air so that it passes downward in the burning fuel, primary air and uncombusted air-fuel mixture are preheated such that complete combustion can be attained upon subsequent addition of secondary air. The second basic feature of the invention is provision of a dense deep bed of char. This is required to maintain a fire which burns hot and is visibly free of smoke even when wet or green wood or green leaves and other burnables are added. This requirement stems from my discovery that even where the air is supplied at the top rather than at the bottom of the fire, air and other gases will tend to rush through the fire bed and cause smoke to appear in the exhaust if the fire bed has holes. A dense deep firebed avoids this problem. In addition, the char bed provides air and air-fuel mixture preheating which facilitates complete secondary combustion. This requirement is met by forming the bottom end of the upper chamber of the firebox as an inverted cone. A third requirement is the admission of secondary air to assure complete combustion of all combustible gases evolved from the heated or burning fuels in the firebox. This markedly increases combustion temperature in the lower portion of the firebox and also makes it possible to control air-fuel ratios so as to avoid sensible heat losses. A fourth requirement is the positioning of the secondary burning zone in a location such that secondary combustion takes place at the highest possible temperature. This requirement is met by surrounding the point of secondary air injection (i.e. the apex of the inverted cone) by a heat retaining (insulated refractory) lower chamber. It is essential that lower chamber combustion take place with sufficient secondary air and at sufficiently high temperature to assure complete combustion. Therefore, no heat exchangers or other heat extracting devices can be placed in the lower chamber.

Figure 1:
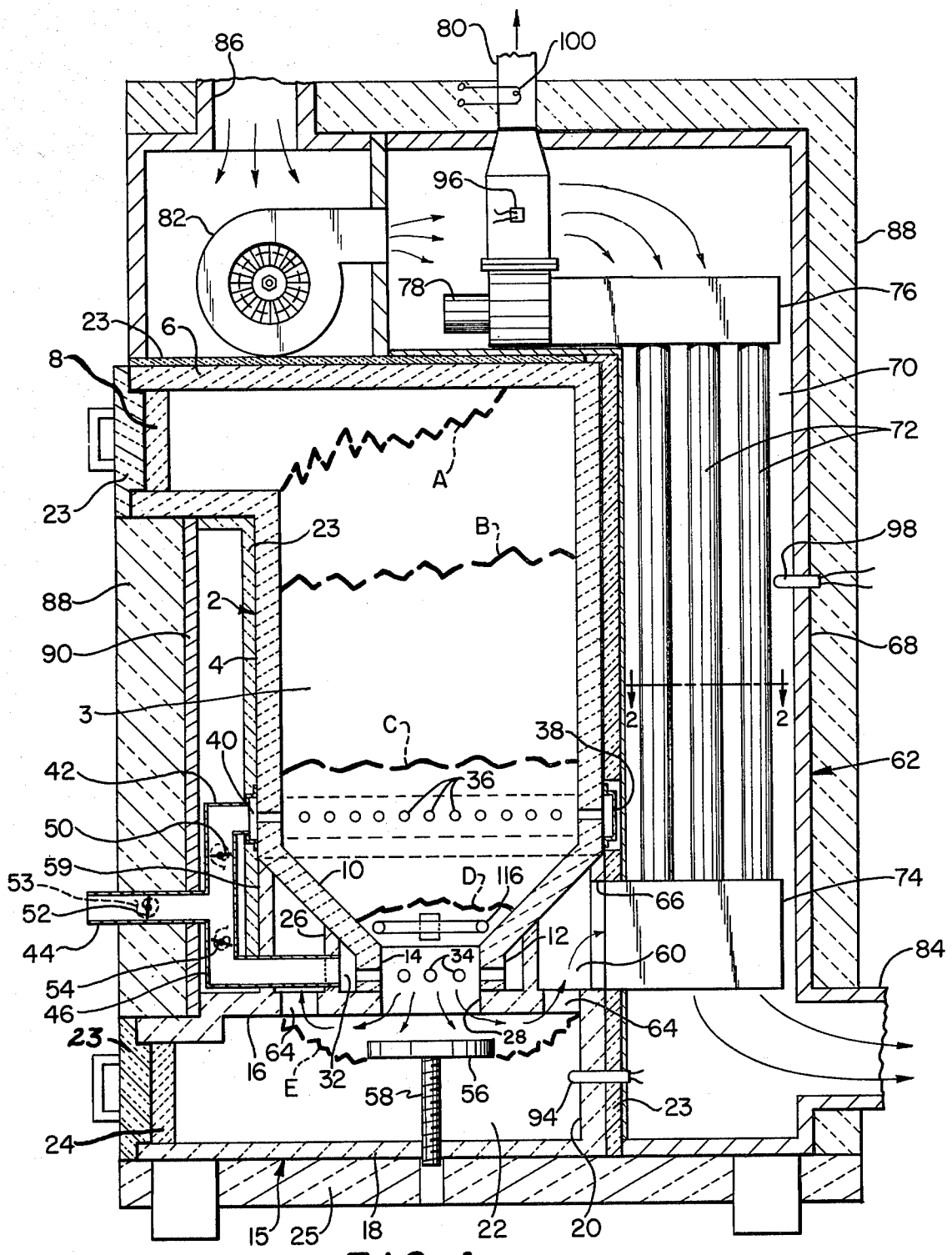
FIG. 1 is a sectional view in elevation of a furnace constituting a preferred form of the invention.
Figure 2:
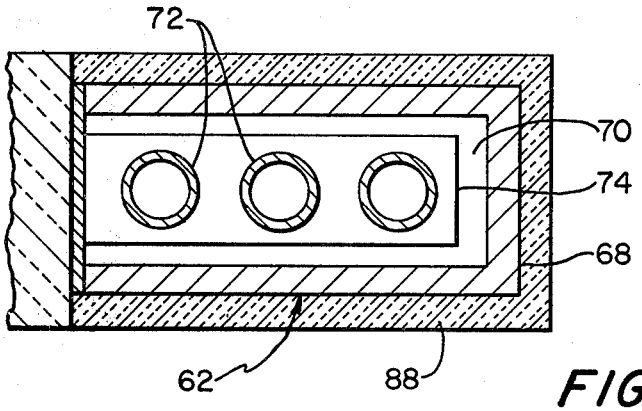
FIG. 2 is a cross-sectional view of the output heat exchanger taken along line 2—2 in FIG. 1.

Turning now to FIGS. 1 and 2, a preferred embodiment of the invention is a furnace for domestic space heating purposes which comprises an upper firebox section 2 that constitutes the upper chamber 3 of the furnace and is made of a high-temperature resistant ceramic material, preferably a ceramic material surrounding and reinforced by a steel mesh. The upper portion 4 of firebox section 2 is preferably cylindrical in shape, but its cross-sectional configuration also may be square or rectangular. The upper end of firebox section 2 is closed off by a top wall 6 but has a side opening that is closed off by an air-tight door 8 and serves as a feed port through which fresh fuel can be added. The bottom portion 10 of the upper firebox section tapers inwardly as shown and terminates in a cylindrical extension 12 which defines a central discharge opening 14 for the upper chamber and serves as a concentrating stage as hereinafter described. While bottom portion 10 is preferably frusto-conical in shape as shown, it may also be frusto-pyramidal in shape. The essential thing is that the side wall(s) of the bottom portion be inclined and form a discharge opening for the upper chamber which is located at or close to the center of the firebox, whereby solids in the bottom section will tend to move inwardly as they drop downward, and air and gasified fuel accelerate as they are drawn down through this opening. Upper firebox section 2 is supported on a lower firebox section or base 15 which has top, bottom and side walls 16, 18 and 20 respectively that form the lower chamber 22 of the furnace firebox wherein secondary combustion takes place and which serves as an ash accumulating compartment. Base 15 also is made of a high-temperature resistant ceramic material, preferably one that is reinforced with steel mesh like firebox section 2. Base 15 has a side opening for lower chamber 22 that is closed off by an air-tight hinged door 24 through which ashes and other non-combustible residue can be removed from the furnace.

Firebox section 2 and base 15, and doors 8 and 24 as well, are covered by a layer of a high temperature-resistant insulating material as shown at 23 and 25. The top wall 16 of base 15 is formed with a cylindrical extension 26 that engages and supports the upper firebox section 2. For this purpose, the upper edge surface of extension 26 is slanted at the same angle as the wall forming the conical bottom portion 10, so as to assure precise positioning of the latter. Top wall 16 is provided with an opening 28 which is coaxial with its cylindrical extension 26. The cylindrical extension 12 of upper firebox section 2 engages wall 16 in concentric relation with opening 28 and preferably the inner diameter of extension 12 is the same as the diameter of opening 28. Extension 12 makes a tight fit with wall 16. Upper chamber extension 12 and cylindrical extension 26 form an annular plenum 32 which communicates with the interior of the firebox through a plurality of holes 34 formed in extension 12 through its full circumference. A second plurality of holes 36 are formed in the lower end of the portion 4 of firebox section 2. Holes 36 also are formed around the full circumference of the firebox. Surrounding and attached to the firebox in line with holes 36 is a U-shaped channel 38 which defines a manifold chamber 40. Attached to channel member 38 is a primary air feed tube 42 which communicates with chamber 40 through a hole in the channel member. Tube 42 connects with a main air supply tube 44 and also a secondary air feed tube 46. The latter is affixed to cylindrical extension 26 and communicates via a hole in the latter with plenum chamber 32.

Tubes 42, 44 and 46 are provided with dampers or other types of air flow control valves 50, 52 and 54. Valves 50, 52 and 54 may be adapted for operation manually, but preferably they are adapted to be operated mechanically or electromechanically and are biased by springs represented diagrammatically at 53 so that they will automatically return to their closed position (i.e., the position shown in FIG. 1) when no opening force is applied thereto, thereby assuring fail-safe operation.

Mounted in lower chamber 22 is a burning plate 56 which is supported by a threaded member 58 which is screwed into a hole in bottom wall 18. Burning plate 56 is aligned with and is larger than the discharge opening 28 in wall 16. Burning plate 56 is circular like discharge opening 28 and cooperates with wall 16 to define a passageway for gases and solids discharged from the upper firebox chamber 3. The proximity of burning plate 56 to wall 16 determines the gas flow velocity through the opening, thus the degree of turbulence in the volume enclosed by jagged line E.

In addition to cylindrical extension 26, the upper firebox section 2 is supported by another cylindrical wall 59 which extends up from wall 16 and engages the upper firebox section at the upper end of its concial bottom portion 10. Wall 59 and cylindrical extension 26 coact with wall 16 and the conical bottom portion 10 of the upper firebox section 2 to define a gas discharge chamber 60. The latter serves to collect hot gases from the firebox and deliver them to a primary heat exchanger 62. Accordingly wall 16 is provided with several openings 64 for delivery of hot gases into chamber 60, and wall 59 is provided with a side opening 66 for delivering hot gases into heat exchanger 62. As shown in FIG. 1, openings 64 are positioned so as to be out of radiative line-of-sight with the secondary combustion region. In this manner, refractory walls 24, 16, 18 and 20 will re-radiate all thermal energy produced by the secondary combustion flame back into the flame. This facilitates high temperature, thus complete, combustion.

In the illustrated embodiment of the invention, exchanger 62 is a gas-to-air heat exchanger and comprises an outer shell 68 which defines a chamber 70 that contains a plurality of tubes 72 that are connected at their opposite ends to inlet and outlet manifolds 74 and 76 respectively. Inlet manifold 74 extends through a hole in shell 68 and makes a fluid-tight connection with wall 59 at side opening 66. Outlet manifold 76 is connected to the inlet side of a conventional electrically powered blower 78. The outlet of blower 78 extends through shell 68 and is connected by a conduit 80 to a chimney or other device for exhausting gases to the atmosphere.

Additionally shell 68 of exchanger 62 has an inlet which is connected to the discharge end of a second electrically powered blower 82 and an outlet 84. In a typical installation outlet 84 is connected to the feed side of a home hot air heating system comprising a plurality of room registers and the return side of the same system is connected to the inlet end of blower 82 via a conduit 86.

The furnace and heat exchanger 62 are preferably enclosed within a casing of a selected insulating material 88 which may be laid up directly against the heat exchanger shell and the firebox or else against a supporting outside metal panel like the one shown at 90.

Operation of blowers 78 and 82 and dampers 50, 52 and 54 may be controlled manually. Preferably, however, they are controlled continuously so as to (1) provide heat as required and (2) assure a clean fire, i.e., a substantially smoke-free effluent.

In accordance with this invention, four different active zones are established in the firebox. The topmost zone is a drying zone where fresh fuel is heated just enough to lose moisture, constituting approximately the space between the broken jagged lines A and B (the space between jagged line A and door 8 may be considered as a fuel hopper). The next lower zone is a pyrolysis zone which is hotter than the drying zone. This zone is located above air holes 36 and constitutes approximately the space between broken jagged lines B and C. The pyrolysis zone is characterized by little or no air, and this deficiency of air causes the fuel therein to be decomposed to char and combustible or oxidizable gases such as CO, H, $N_2$, $SO_2$ and $NO_2$. The next lower zone is the primary burning zone. This zone is substantially hotter than the pyrolysis zone and extends from slightly above holes 36 to slightly above holes 34, constituting approximately the space between broken jagged lines C and D. In this zone combustion occurs at a temperature of from about 750° F. to about 1200° F. The bottommost zone in the firebox is the secondary burning zone. It extends from just above holes 34 down to about burning plate 56 and constitutes approximately the space between jagged line D and jagged line E. In this zone combustion occurs at a temperature of between about 1200° and about 1900° F. The exact temperature established in the primary and secondary combustion zones is determined by the composition of the fuel and the amount of air fed in via tubes 42 and 46. As explained hereinafter, the primary combustion is conducted so as to provide a dense smokey fire typical of oxygen-starved combustion, while the secondary combustion provides a clean smoke-free fire typical of a high temperature clean combustion reaction.

The furnace tends itself to efficient burning over a wide range of heat output as follows: when burning at the maximum output, both valves 50 and 54 are full open as is valve 52. Extraction blower 78 is operating at maximum speed, as is blower 82 which supplies heated air to the space being warmed. In this condition, burning takes place in the zone defined by jagged line C and jagged line D, and pyrolysis of fuel above this zone is maximized. When the lowest heat output mode, or idle mode is called for (by external thermostat or other controller), extraction blower 78 is switched to its lowest speed, and valve 50 is closed, cutting off the primary air supply. Combustion can no longer take place in the zone defined by jagged lines C and D, thus the rate of fuel gasification, or pyrolysis, in upper firebox chamber 2 is reduced. Fuel gasification in the idle mode takes place only as a result of combustion in the zone defined by jagged lines D and E, and by means of heat transfer from the lower chamber 22 to the upper chamber 3. Upper chamber 3 and lower chamber 22 communicate thermally and are both insulated completely from the furnace exterior. Fuel gas is produced at a lower rate, extraction blower 78 operates at a reduced speed, and secondary air is supplied at a lower, but still stoichiometric, rate; thus complete combustion occurs at a greatly reduced rate. Although combustion takes place at a reduced rate in the idle mode, the insulated, refractory lower chamber 22 retains its heat for long periods of time, thereby maintaining the high flame temperature required for complete combustion. The temperature in lower chamber 22 is not easily reduced because heat extraction is not made in that chamber, but deferred until the hot gases pass into heat exchanger 62.

Figure 3:
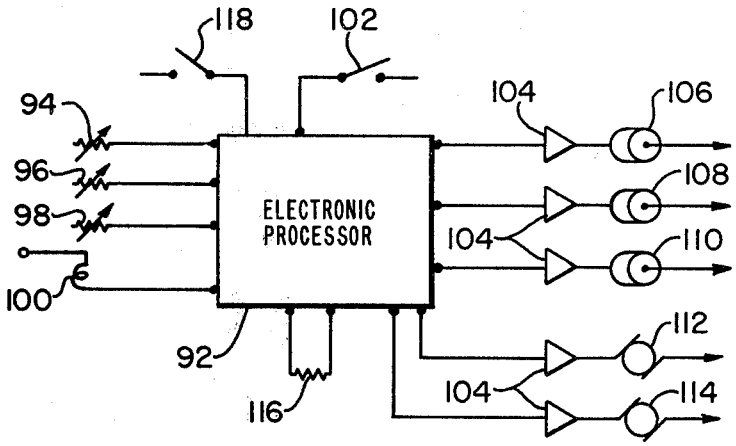
FIG. 3 is a schematic diagram of a preferred form of system for controlling furnace operation.

The invention lends itself to automatic operation under the control of an electronic microprocessor as shown at 92 in FIG. 3. Efficient pyrolysis and combustion, a smoke-free exhaust and optimum heat utilization are obtained by controlling the relative and combined rates of flow of air fed to the primary and secondary burning zones, the rate at which hot gases are exhausted to the atmosphere via blower 78 and the rate at which air is circulated via blower 82. These parameters also affect the temperature of the hot gases withdrawn from the firebox, the temperature of the same gases as they leave blower 78, the temperature of the air surrounding heat exchanger pipes 72, and the amount of smoke in the hot gases passed to the stack by blower 78. Accordingly, in the proposed mode of practicing this invention temperature sensors are installed as shown at 94, 96 and 98 to monitor the temperature of the hot gases as they pass into and out of heat exchanger 62 and the temperature of the air in chamber 70. Sensors 94–98 may be thermistors. Also a fourth opacity sensor 100 is installed in conduit 80 to sense how much, if any, smoke is in the stack gases. Sensor 100 may take various forms and preferably is an ionization-type smoke detector. These sensors are all connected to provide inputs to processor 92. Additionally a conventional house thermostat represented as a switch 102 is coupled to the processor. The latter has three output lines connected via amplifiers 104 to transducers 106, 108 and 110 which are arranged to operate dampers 50, 52 and 54 respectively, plus two other output lines which are connected via other amplifiers 104 to the motors 112 and 114 of blowers 78 and 82 respectively. Additionally an electrical heating element 116 is positioned in the lower end of the upper firebox chamber as shown in FIG. 1 and connected for energization by processor 92. Heating element 116 may be a CALROD ® type element and preferably is in the form of a circular split ring whose ends are fitted with terminals that are connected to a suitable power supply via microprocessor 92. If desired, additional sensors may be installed in the system at a suitable location, e.g., in conduit 80, to measure the amount of one or more of the following in the gases which are exhausted to the atmosphere: $O_2$, CO and $CO_2$. The microprocessor is programmed so that it will continuously accept all of the sensor inputs along with external heat demand commands provided by thermostat 102, and from such inputs the processor will synthesize signals for appropriately controlling dampers 50–54 and blowers 78 and 82 so as to achieve efficient combustion with a combustion effluent that is substantially completely free of smoke. Additionally the processor may be programmed to energize heating element 116 whenever the fire needs to be rekindled; as an alternative safety measure, the processor may be controlled to energize heating element 116 for a predetermined time period whenever the thermostat commands the processor to start up either or both of the blowers or to open one or more of the dampers. Of course, the heating element may be connected for energization upon the closing of a manually operable switch, so that the user may operate it independently of processor 92. Inherent safety of operation is provided by using dampers that are spring-biased to return to closed position to completely exclude oxygen from the firebox if any failure mode is encountered. As an alternative measure the transducers 106, 108 and 110 may be arranged so that they will automatically close the dampers when no signal is applied thereto by processor 92.

Operation of the foregoing apparatus will now be described starting with the furnace in cold condition. When firing from a cold start, charcoal is poured into the firebox via door 8 in an amount sufficient to form a layer which extends from burning plate 56 to above the level of heating element 116. Then the latter is energized, e.g. by closing a START button 118. This causes the heater to ignite the charcoal and also activates processor 92. Once burning is underway (as determined by a rise in temperature detected by sensor 94), processor 92 shuts off heater 116 and the furnace is allowed to operate normally. If a charge of relatively cold or damp fuel is added, the processor adapts the system so that heat is retained in the firebox until it has reestablished the thermal environment required for pyrolysis to be achieved and maintained, whereby smoking following stoking is avoided. Fuel is added to the system so as to substantially fully fill the firebox to a substantial level above the holes 36. Thereafter fuel is added to the system as required.

In the normal operation, the charge of fuel moves downward in the upper firebox chamber through its funnel shaped apex to lower chamber 22 as fuel is consumed and during this movement, it passes through the several discrete zones already described. In the drying zone the fuel is heated to a temperature high enough, preferably between about 220° and 300° F., where it will undergo drying. Then the fuel moves downward through the pyrolyzing zone where the temperature is between about 300° F. to about 750° F. In this zone the fuel is decomposed by pyrolysis into char and a variety of combustible and non-combustible gases, e.g., CO, $CO_2$, NO, $NO_2$ and $H_2$. These gases are drawn out of the upper firebox chamber through opening 28 while the char moves downward due to gravity. Ash and any other unburned residue from the firebox falls into ash collection chamber 22. As the gases and char move downward they enter and pass through the primary burning zone where fresh air supplied via openings 36 cause combustion to occur and be supported. The amount of air supplied via openings 36 is preferably maintained to a level of between about 0.8 and 1.0 of the theoretical amount required for exact stoichiometric proportions, whereby combustion is caused to occur and be maintained at a temperature of between about 750° and about 1200° F. Secondary high temperature burning of the char and gases is achieved in the secondary burning zone where air is admitted in an amount which at least equals and preferably is in excess of the amount required to sustain combustion at a temperature of between about 1200° and about 1900° F.

During normal operation the cylindrical portion 12 of the firebox is filled with hot coals, i.e., burning char, which are supported by hot coals and ashes accumulating on burning plate 56. The ashes and any other unburned residue are caused to move into chamber 22 by gravity coupled with the cyclone separating effect of the existing gases which are sucked out by blower 78. The ash and whatever other unburned residue accumulates in chamber 22 is removed via door 24. The hot gases exit via openings 66 and are sucked up through pipes 72 of heat exchanger 62 to exhaust conduit 80 by blower 78. In exchanger 62, the hot gases give up heat via pipes 72 to the air circulated through chamber 70 by blower 82. The heated air is then used to supply heat to a dwelling in a known manner.

Although the furnace just described is preferably operated automatically by means of a system as shown in FIG. 3, it is to be appreciated that operation of the blowers may be initiated by manually operated switches and the dampers 50, 52 and 54 also may be of a type which may be manually set in selected positions. With such an arrangement a thermostat would be used primarily for the purpose of initiating and controlling operation of the blower 82.

It is to be noted also that the furnace may be used for heating hot water or for supplying heat to a hot water heating system, in which case the gas-to-air heat exchanger 62 would be replaced with a gas-to-liquid heat exchanger.

Providing dampers which are adapted to automatically move to closed position in the case of a power outage assures a fail-safe mode. Closing of the dampers shuts off the air supply and, with the termination of operation of blower 78, the fire will be rapidly smothered and will go out because of it being effectively sealed. Additionally the ash which is produced is essentially in a fine powder form due to the fact that it undergoes considerable turbulence as it is sucked out of the firebox and encounters burning plate 56. If desired, the base of the furnace may be provided with an ash-storage drawer located in compartment 22, so that ash removal may be effected simply by pulling out and emptying the drawer.

The product of the furnace is a mixture of hot gases, essentially all of which is made up of nitrogen, carbon dioxide and water vapor. These hot gases are essentially non-corrosive and can be easily cooled and handled by existing type heat exchangers and blowers. Although the furnaces may be used to dispose of plastic materials, it is preferably to remove chlorinated plastics from waste fuel materials in order to preclude the formation of halogen gases or hydrochloric acid emissions.

The furnace hereinabove described has certain unique features and advantages. First of all, the upper section 2 of the firebox is made air-tight by door 8 and in addition the firebox height above the primary air inlets 36 to the level of the bottom of door 8 is set so that the ratio of that height to firebox diameter is at least 1:1 and preferably 2:1 or greater. This assures that all of the drying zone and substantially all of the pyrolysis zone can be maintained in an air-starved condition when the fuel charge extends up close to the level of the bottom of door 8, since the fuel in the lower end of the pyrolysis zone tends to act as a barrier between the fresh fuel in the drying zone and the upper end of the pyrolysis zone. Secondly, the necked portion 12 at the lower end of the upper firebox section 2 acts as a concentrating zone and is required to assure high turbulence mixing of air with the combustible gases and solids passing from the primary burning zone to the secondary burning zone. A clean and smoke-free fire requires (1) a high enough temperature, (2) sufficient oxygen and (3) intimate mixing of fuel and air, to assure complete and rapid combustion of all combustibles. The intimate mixing requirement is met by the necked portion 12 which causes the combustible gases and solids to be concentrated as they move down from the conical section to the burning plate. Operation of blower 78 causes the combustible gases in the firebox to be sucked through necked portion 12 and past burning plate 56 at a high velocity. This high velocity coupled with the radial spreading that occurs as the gases pass around burning plate 56 assures intimate high speed mixing of those gases with the fresh air or oxygen admitted via tuyeres 34. Thirdly the dual burning zones and dual damper controls permit better control of combustion and also better control of fuel comsumption. Providing two air feeds makes it possible to establish and maintain two combustion zones differing in temperature and degree of combustion, and providing a separate damper for each air feed makes it possible to control and vary the temperature, degree and rate of combustion in each of the two combustion zones. The primary air feed is controlled and operated so that a dense, smokey and relatively low temperature fire typical of oxygen-starved combustion is maintained in the primary combustion zone, whereby the fire in the primary combustion zone gives off enough heat by radiation and conduction to produce pyrolysis of fresh dry fuel in the pyrolysis section but not enough air is available to support combustion of the fuel in the pyrolysis section. Stated another way, adjusting the upper damper 50 controls the rate of primary combustion and also the rate of pyrolysis, while adjusting the lower damper 54 makes it possible to vary the ratio of air between the two burning zones and to make certain that complete combustion is achieved in the secondary zone. Fourthly, the furnace is designed so that little or no heat is extracted from the fire ball in the secondary zone by radiation to the surrounding environment and also, as an optional measure, so that the size of the fireball can be increased or decreased in accordance with increases or decreases in heat output demand. The fireball of hot coals and combusting gases is formed in the secondary combustion zone between burning plate 56 and the upper wall 16 of base 15, generally with a perimeter as represented by jagged line E or even larger. The invention is based on the objective of minimizing extraction of heat from the fireball, since if the fireball is chilled too much, e.g., to below about 1000° F., the combustion in the secondary zone will become incomplete and will not be smoke-free even though excess air might be present in the secondary burning zone. It is for this reason that the base 15, or at least that portion which defines chamber 22, is made of a refractory, i.e. high temperature ceramic material and is highly insulated against heat loss. The hot insulated refractory walls act to reradiate heat back to the fireball to maintain it at a desired temperature. Making burning plate 56 adjustable as to its height allows it to be used as a throttle to control the size of the fireball. Lowering the burning plate increases the size of the fireball. It also increases the volume of gases discharged from the furnace by blower 78 and hence the heat output of the furnace. In this connection it should be noted that when the volume of exiting gases increases, more air will be supplied automatically via tuyeres 36 and 34 due to the drop in pressure which results naturally from the increase in the amount of gases discharged from the concentrating section 12, even without any change in the settings of dampers 50 and 54. A final important aspect of the invention is this: not only is some of the heat of combustion given off by the primary combustion reaction used directly to supply the heat required to pyrolyze fresh dry fuel, but in addition the combustible products of pyrolysis are consumed substantially completely within the primary and secondary combustion zones.

An obvious modification of this invention is to provide additional air feeds or tuyeres. Thus, for example, another set of air feed openings could be added between holes 36 and 34 to further control combustion. Also air feed holes 34 and 36 could be raised or lowered and a blower could be connected to air supply tube 44 to inject air or oxygen at a high rate. Also heating element 116 could be replaced by an igniter in the form of a gas pilot burner and the cross-sectional shape of neck portion 12 could be modified. Heating element 116 also could be located elsewhere in the primary burning zone or lower in the secondary burning zone. Preferably upper firebox section 2 and lower firebox section 15 are made of a ceramic such as mullite or alumina, but other refractory materials may be used instead.

Other advantages and modifications will be obvious to persons skilled in the art.

What is claimed is:

1. A plural-chamber fire box comprising:

first refractory means having surfaces defining an upper chamber in which solid fuel may be stored, dried, gasified and partially combusted, at least a portion of said upper chamber converging in a funnel-like fashion to an opening at the bottom of said upper chamber;

second refractory means having surfaces defining a lower chamber which communicates with the upper chamber through said opening, additional refractory means forming a structure which surrounds and contains a lower portion of the upper chamber and said opening;

means for introducing primary combustion air into the converging region of the upper chamber such that, in the presence of heat, various degrees of partial combustion may take place in said upper chamber;

means for introducing secondary combustion air at the periphery of the opening so that complete combustion of gases may take place in said opening and the lower chamber;

means located in the lower chamber below said opening for supporting (a) hot char at the bottom of the upper chamber so that the hot char serves as a gas igniter and (b) regulating the velocity and volume of total flow of air and combustion products through the firebox;

means comprising at least part of said additional refractory means defining a passageway for exiting unreacted air and hot gaseous combustion products from the lower chamber so that the heat of said unreacted air and gaseous combustion products assists in maintaining the temperature above that required for complete combustion of smoke, creosote, and other noxious emissions; and insulation disposed about said first, second and additional refractory means for thermally isolating the outside surfaces of the upper and lower chambers from surrounding structures in a manner which does not restrict thermal communication between said upper and lower chambers.

2. A plural chamber firebox according to claim 1 wherein said opening is disposed and arranged so that it is exposed to and surrounded by high temperature flame combustion occurring in said lower chamber.

3. A plural chamber firebox according to claim 1 wherein said means for supplying air to said upper chamber and said means for supplying air to the periphery of said opening are operable and controllable separately.

4. A plural-chamber firebox according to claim 1 wherein said upper chamber is provided with a thermally insulated, air-tight door for allowing introduction of fuel to said upper chamber.

5. A plural-chamber firebox according to claim 1 wherein said lower chamber has an access port for removal of ash and solid residues from said lower chamber.

6. A plural-chamber firebox according to claim 1 further including an extraction blower for sustaining the flow of primary and secondary air to and through said firebox and for extracting the unreacted air and gaseous combustion products from the lower chamber of said firebox.

7. A plural-chamber firebox according to claim 6 wherein said passageway is arranged for conducting gases from said lower chamber around the converging region of the upper chamber so as to supply heat to said converging region.

8. A plural-chamber firebox according to claim 1 wherein said means for introducing primary combustion air comprises a plurality of ports around and connecting with the interior of said upper chamber, and said means for introducing secondary combustion air comprises a plurality of ports around and connecting with said opening.

9. A plural-chamber firebox according to claim 1 further including separate valve means for individually controlling the flow of air through said first and second plurality of ports.

10. A plural-chamber firebox according to claim 1 further including a heat exchanger for recovering heat from hot unreacted air and gaseous combustion products exiting from the lower chamber.

11. A plural-chamber firebox according to claim 1 wherein said means located in the lower chamber comprises a positionally adjustable plate spaced below said opening.

12. A plural-chamber firebox according to claim 1 wherein said additional refractory means forms a supporting structure for said upper chamber.

13. A plural-chamber firebox according to claim 12 wherein said additional refractory means is attached to and supported by said second refractory means.

14. A plural-chamber firebox according to claim 1 wherein said additional refractory means forms first and second walls surrounding a lower portion of said upper chamber and said exit passageway is defined at least in part by said first and second walls.

15. A furnace for consuming solid carbonaceous fuels for the purpose of space and hot water heating comprising: a refractory firebox comprising first refractory means defining an upper chamber and second refractory means defining a lower chamber, said upper chamber having an opening at its lower end and at least a portion of said upper chamber converging in funnel-like fashion to said opening, said lower chamber connecting with said upper chamber through said opening;

an air-tight door for allowing access to said upper chamber for the introduction of fuel;

an access port for removal of ash and other solid residues from said lower chamber;

means for introducing primary combustion air into said upper chamber at or proximate to said converging portion of said upper chamber so that, in the presence of heat, various degrees of partial combustion may occur in said upper chamber;

means for introducing secondary combustion air to the periphery of said opening so that complete combustion can occur in said opening and in said lower chamber;

an adjustable burning plate disposed in the lower chamber below and in line with said opening for supporting hot solid fuel at the bottom of the upper chamber and regulating the velocity and volume of flow of air and combustion products through said opening into said lower chamber;

a heat exchanger for extracting heat from the hot furnace exhaust gases and transferring said heat to a working fluid such as air or water;

means providing an exit passageway for conducting hot exhaust gases from said lower chamber through said heat exchanger;

an extraction blower for sustaining the flow of primary and secondary combustion air into and through said firebox and for extracting hot unreacted air and gaseous combustion products from the firebox via said passageway; and valve means for regulating the proportion of primary and secondary combustion air delivered to said firebox so as to regulate the portion of combustion which occurs in the upper chamber relative to that in the lower chamber and for regulating the rate of solid fuel gasification and combustion in said firebox.

16. A furnace according to claim 15 having first and second valves for separately and independently supplying primary and secondary air respectively to said firebox.

17. A furnace according to claim 15 further including insulation disposed about said fire box for thermally insulating the outer surfaces of said upper and lower chambers from surrounding structures in a manner which does not restrict thermal communication between said upper and lower chambers.

18. A furnace according to claim 17 wherein said refractory firebox comprises refractory means forming an extension of said upper chamber at said opening, and said means for introducing secondary combustion air is adapted to introduce secondary combustion air via openings in said extension.

19. A furnace according to claim 18 wherein said refractory firebox comprises first and second mutually spaced refractory means surrounding said extension and coacting to at least partially define said exit passageway.

20. A furnace according to claim 14 wherein said firebox comprises refractory means supporting said first refractory means on said second refractory means.

21. A furnace according to claim 15 wherein said door is made of a refractory material and is thermally insulated and further including a thermally insulated refractory door for closing off said access port.

* * * * *